US006454152B1

(12) United States Patent
Nayrac et al.

(10) Patent No.: US 6,454,152 B1
(45) Date of Patent: Sep. 24, 2002

(54) APPARATUS FOR FASTENING PLUGS BY COMPRESSED GAS

(75) Inventors: Frédéric Nayrac, Valence; Patrick Herelier, Tournon; Alain Vettoretti, Valence, all of (FR)

(73) Assignee: Societe de Prospection et d'Inventions Techniques Spit, Bourge-les-Valence (FR)

( * ) Notice: Subject to any disclaimer, the term of this patent is extended or adjusted under 35 U.S.C. 154(b) by 0 days.

(21) Appl. No.: 09/453,557

(22) Filed: Dec. 3, 1999

(30) Foreign Application Priority Data

Dec. 4, 1998 (FR) ..... 98 15341

(51) Int. Cl.[7] ..... B25C 1/04
(52) U.S. Cl. ..... 227/120; 227/127
(58) Field of Search ..... 227/93, 120, 135, 227/136, 119, 15, 18, 16, 8, 10, 127

(56) References Cited

U.S. PATENT DOCUMENTS

| | | | | |
|---|---|---|---|---|
| 4,053,094 A | | 10/1977 | Males | |
| 4,196,833 A | | 4/1980 | Haytayan | |
| 4,197,974 A | * | 4/1980 | Morton et al. | 227/120 |
| 4,597,517 A | * | 7/1986 | Wagdy | 227/8 |
| 4,778,094 A | * | 10/1988 | Fishback | 227/120 |
| 4,821,938 A | * | 4/1989 | Haytayan | 227/10 |
| 5,020,712 A | * | 6/1991 | Monacelli | 227/120 |
| 5,816,468 A | * | 10/1998 | Yang | 227/120 |
| 5,975,399 A | * | 11/1999 | Oehri et al. | 227/136 |
| 6,053,389 A | * | 4/2000 | Chu et al. | 227/120 |

FOREIGN PATENT DOCUMENTS

| | | |
|---|---|---|
| DE | 24 32 642 | 1/1976 |
| EP | 0 835 726 | 4/1988 |
| FR | 2 106 135 | 4/1972 |

* cited by examiner

*Primary Examiner*—Scott A. Smith
(74) *Attorney, Agent, or Firm*—Lowe Hautpman Gilman & Berner, LLP

(57) ABSTRACT

The apparatus comprises a removable magazine for the supply of fasteners, designed to contain a strip of fastener-holding rings, a fastener-guide (3) and a unit (4) for shearing the strip of fastener-holding rings, and which is functionally a single unit. The shearing unit (4) and the fastener supply magazine are adapted to work together to house a skirt (11), integral with the shearing unit (4), forming a passage (12) for fastener input, in a reception compartment of the skirt (11).

10 Claims, 3 Drawing Sheets

APPARATUS FOR FASTENING PLUGS BY COMPRESSED GAS

BACKGROUND OF THE INVENTION

The invention concerns an apparatus for fixing fasteners by means of combustion of an inflammable compressed gas, used in particular in the building industry to fasten to a support mounting plate for the fixing of cables, ducts and other accessories of this type.

This type of fixing apparatus comprises a cylinder, into which is slide mounted a fastener propelling piston, a combustion chamber, a housing to receive a compressed gas cartridge, a removable magazine for the supply of fasteners, a fastener-guide, a shearing unit and a handle.

The fastener supply magazine, removable, contains a strip of fastener-holding rings. The shearing unit comprises a passage to accept fasteners which connects with the fastener magazine and extends forwards via a fastener guide passage of the fastener-guide, for the purpose of guiding the fastener until it penetrates the support.

At time of firing, the fastener at the head of the support strip is inserted into the shearing unit and, after the apparatus is pressed against a support, the piston is propelled forwards and strikes the fastener which has been accepted into the shearing unit. As a result of the strike, the strip of fastener-holding rings is sheared, the fastener at the head of the strip, detached, is projected forwards, guided by the fastener-guide, and penetrates the support.

The shearing unit of known devices consists of two parts, upper and lower, each having formed in it a groove semi-circular in cross-section. The upper part is integral with the fastener-guide and with a casing enclosing the cylinder and the combustion chamber, and the lower part is integral with the fastener supply magazine. When the fastener supply magazine is mounted on the apparatus, the lower part and the upper part are indexed in relation to each other and firmly united by means of two pins projecting from the lower part and received into two transverse openings formed in the upper part. After the two parts, upper and lower, are firmly joined, the two semicircular grooves form the fastener reception passage. The fastener supply magazine and the shearing unit are then locked, by means of a locking system with a knob, in order to prevent the separation of the upper and lower parts.

When the fastener magazine is withdrawn from the apparatus, the lower part of the shearing unit is likewise removed. For safety reasons, a system, usually electronic, prevents the firing of the apparatus without the fastener magazine.

The operation consisting of indexing the two parts of the shearing unit and then locking the latter is tedious. In addition, with the fixing apparatus described above, it is impossible to fire without the fastener supply magazine. However, it would be of interest to be able to use the apparatus without its fastener magazine, for example for fixing a premounted fastener onto a part to be fixed.

SUMMARY OF THE INVENTION

The present invention aims to overcome the above disadvantages.

To this end, the invention concerns a fastener fixing apparatus comprising a removable magazine for supplying fasteners, designed to contain a strip of fastener-holding rings, a fastener-guide and a unit for shearing the strip of fastener-holding rings, characterised by the fact that the shearing unit is functionally a single unit.

With the fixing apparatus of the invention, after removal of the apparatus's fastener magazine, the shearing unit remains intact. The apparatus can therefore be used with or without the fastener magazine. As a result, the safety system preventing firing after removal of the fastener magazine is eliminated. Furthermore, the apparatus, without the fastener magazine, can, be used to fix a fastener in a deep section, which would be impossible with the fastener magazine mounted onto the apparatus because of the magazine's bulk.

To advantage, the shearing unit and the fastener supply magazine are adapted to work together by housing a skirt, to form a fastener input passage, in a compartment for receiving the skirt.

It is thus possible to index the magazine in relation to the apparatus without difficulty.

For preference, the skirt and its housing compartment are modelled so that the one fits into the other loosely.

As a result, the fastener magazine can be very easily mounted onto the apparatus.

For preference again, the skirt is integral with the shearing unit.

For further advantage, the design is such that the fastener supply magazine fixes onto the apparatus by means of a snap fit.

BRIEF DESCRIPTION OF THE DRAWINGS

In a particular embodiment, the means for achieving a snap fit comprise a shoulder, supported by a spindle mounted on return mechanisms intended to act in conjunction with a cutout to receive the shoulder, extended by at least one finger to thrust onto, and lock the shoulder in place.

The invention will be better understood with the aid of the following description of a particular embodiment of the fixing apparatus of the invention, with reference to the appended drawing in which.

DETAILED DESCRIPTION OF THE INVENTION

Figure 1:
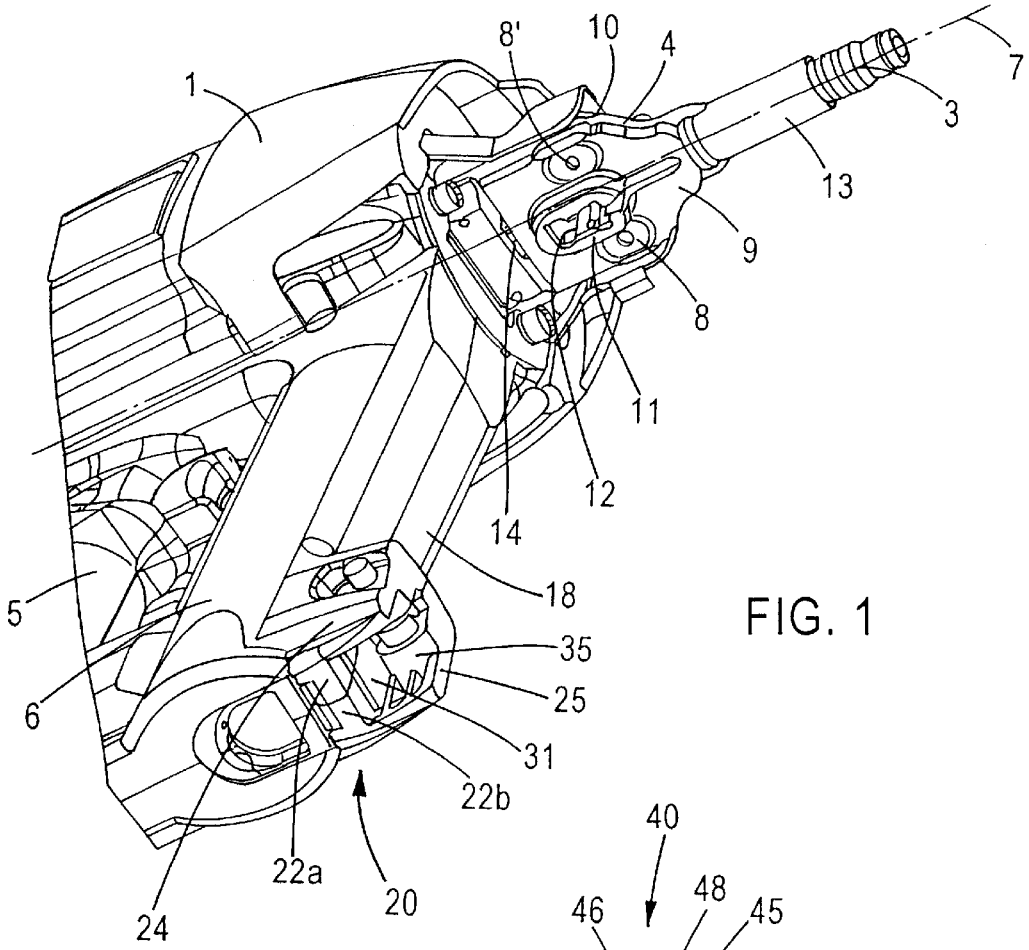
FIG. 1 represents a view in partial perspective of the fixing apparatus without fastener magazine.
Figure 2:
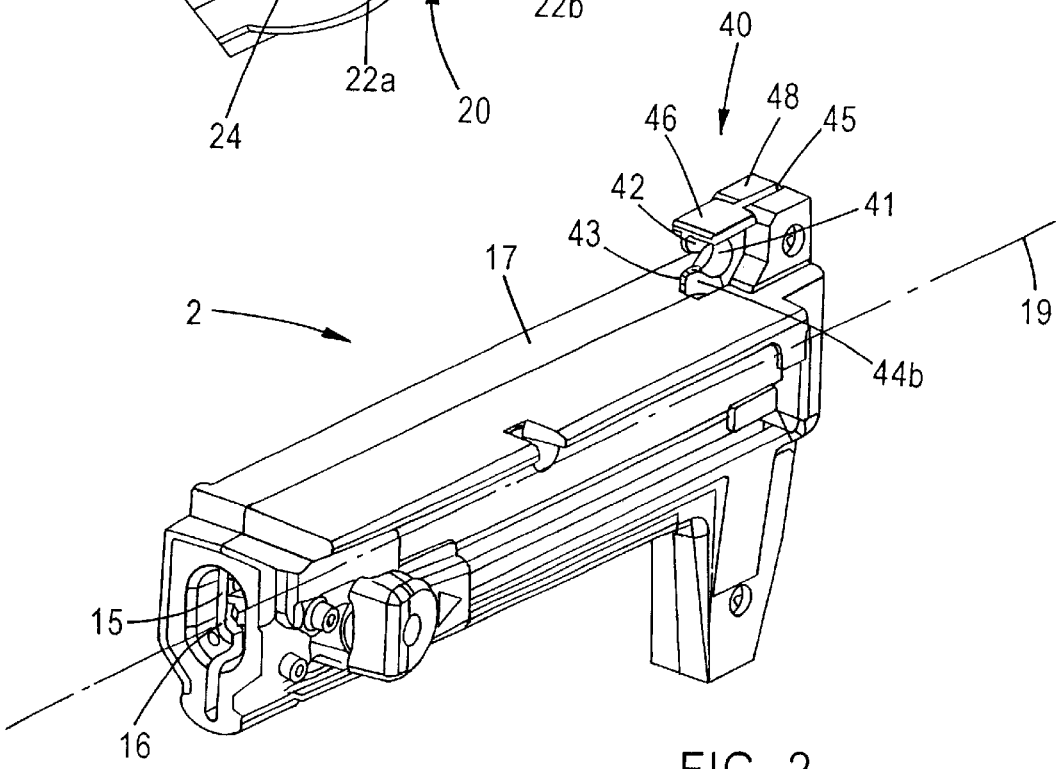
FIG. 2 represents a perspective of the fastener magazine for the apparatus in FIG. 1.

It should be noted now that "the front" and "the rear" indicate the direction towards which the fastener is propelled at time of firing and the opposite direction respectively.

The fastener fixing apparatus comprises a casing 1 with integral handle 5 and a housing 6 to receive a compressed gas cartridge, a removable magazine 2 for supplying fasteners, designed to contain a strip of fastener-holding rings, a fastener-guide 3, a unit 4 for shearing the strip of fastener-holding rings and an anti-firing safety system.

The casing 1 encloses a cylinder, in which is slide mounted a fastener-propelling piston, a combustion chamber and a battery housing, not shown.

The anti-firing safety system prevents any firing without first pressing the apparatus against a support.

The fastener-guide 3 and the shearing unit 4 extend forwards of the casing 1, along a longitudinal axis 7. The handle 5 extends approximately at right angles to the axis 7, here parallel to the housing 6 of the compressed gas cartridge and to the rear thereof. The handle 5 and the housing 6 extend below the casing 1, in an axial (that is containing the axis 7) median plane of the apparatus, which will subsequently be termed "plane P".

The shearing unit 4 consists of two parts, lower 9 and upper 10, in each of which is formed a cut-out of semicircular cross-section and firmly fastened to each other by means of screws 8, 8'. It is stressed here that, since the two parts, lower 9 and upper 10, are firmly fixed to each other, the shearing unit 4 is functionally a single unit. A shearing unit formed from a single part could equally well have been envisaged.

The two cut-outs of the lower 9 and upper 10 parts of the shearing unit 4 form a fastener reception passage extending forwards via a fastener guide passage going through the fastener-guide 3 and intended to guide the fastener when fired, until it penetrates a receiver material.

The upper part 10 of the shearing unit 4 has integral with it at its forward end a fastener-guide carrier 13 into which is slide mounted the fastener-guide 3. The fastener-guide 3, mounted in this way so that it slides in relation to the shearing unit 4, here functions as a probe to check for pressing against a support and closure of the combustion chamber.

The lower part 9 of the shearing unit 4 is integral with an external projecting skirt 11 forming a through passage 12 bringing the fasteners into the shearing unit 4, which communicates with the latter's fastener reception passage.

The back section of the shearing unit 4 is received and screwed into a reception cradle 14, integral with the front part of the casing 1.

The fastener magazine 2 encloses a housing for a strip of fastener-holding rings, with an upper opening 15, and a system for impelling the strip of fasteners towards the upper opening 15. The housing for the strip of fasteners connects via the upper opening 15 with a compartment 16 for the skirt 11 of the shearing unit 4. The magazine 2 extends along a longitudinal axis 19. Subsequently the median plane of the magazine 2 containing the axis 19 will be termed "plane P'".

The shearing unit 4 and the fastener magazine 2 are designed to work in conjunction by housing the skirt 11 in its reception compartment 16, the skirt 11 and its reception compartment 16 being modelled so that the one fits into the other loosely.

The fastener magazine 2 has a rear face 17, made to appear opposite a front face 18 of the housing 6. The face 17 carries at its lower end a female snap fit part 40 intended to act in conjunction with a male snap fit part 20 integral with the lower end of the face 18, to achieve the fixing of the fastener magazine 2 onto the apparatus.

The male snap fit part 20 comprises a spindle 21 supported by two flanges 24, 25 and itself supporting two shoulders 26*a*, 26*b*, in the form of collars.

The two flanges 24, 25 extend overall parallel to the plane P of the apparatus, on either side of the latter, and the spindle 21 is at right angles to this plane P. The two flanges 24, 25 are extended backwards by two fixing lugs 22*a*, 22*b* respectively, integral with the housing 6 and resting against each other.

The flange 25 comprises a housing 27 to receive an end part 21*a* of the spindle 21, projecting towards the inside of the male part 20. A spring 28 has one end pressing against the bottom of the housing 27, and the other end against the bottom of an axial cavity 29 formed in the end part 21*a*. The spindle 21 is thus spring mounted and has axial translatory motion.

The flange 24 comprises a housing 30 to receive the shoulder 26*b*, projecting towards the inside of the male part 20. A transverse opening 31, for the passage of the end part 21*b* of the spindle 21 opposite the end part 21*a*, is formed in the base of the housing 30. The spindle 21 thus projects laterally from the flange 24 outwards. The end part 21*b* is threaded and accepted into a tapped hole 33 formed in a knob 32 for moving the spindle 21, and has two flats intended to work in conjunction with two twin flats of the opening 31, in order to block the rotation of the spindle 21. A stop 34, intended to prevent axial translatory movement of the knob 32, is fixed onto the external lateral surface of the flange 24 and has an opening through it for the passage of the spindle 21.

Translatory motion of the spindle 21 is limited, on the one hand by stopping the shoulder 26*a* against the edge of the housing 27 and, on the other hand, by stopping the shoulder 26*b* against the edge of the opening 31, at the base of the housing 30.

Housings 27 and 30 are separated from each other by a space 36 to receive the female snap fit part 40, as will be explained later.

Figure 6:
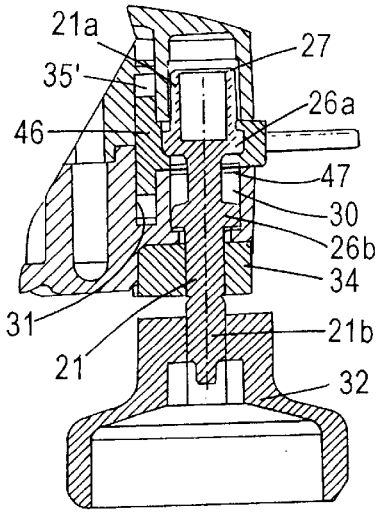
FIG. 6 shows a cross sectional view of the snap fit system of FIG. 3 after fixing and before locking, along the line VI—VI.
Figure 7:
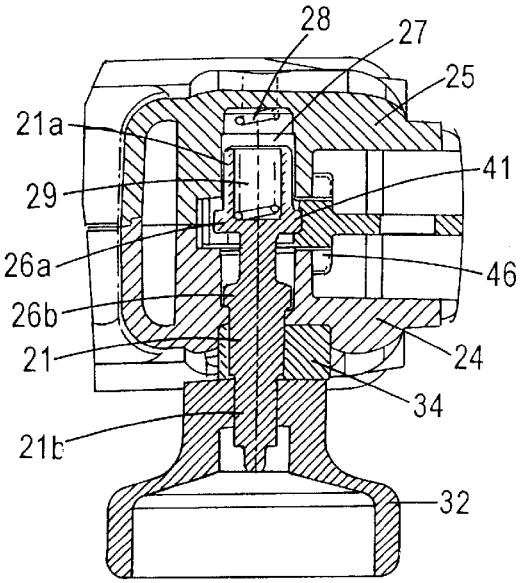
FIG. 7 shows a cross sectional view of the snap fit system of FIG. 3 after locking, along the line IV—IV.

The two fixing lugs 22*a*, 22*b*, form a free surface 31, extending in the area and to the rear of the spindle 21 in a plane which is overall at right angles to the axis 7. The two flanges 24, 25 form between them a lower passage 35 for insertion of the female snap fit part 40 extending upwards via a passage 35' (FIG. 6) to receive a plate 46 for positioning the female snap fit part 40, formed between the surface 31 and the walls of housings 27 and 30.

Figure 3:
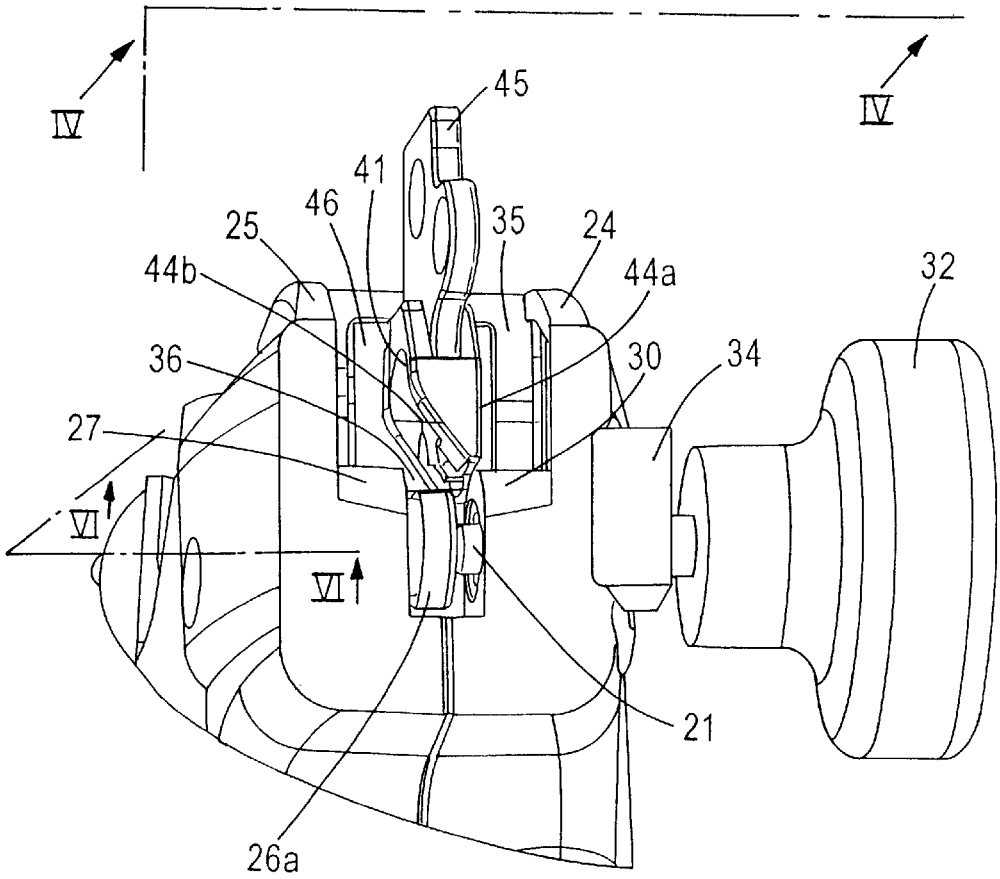
FIG. 3 shows a perspective of a snap fit system for fixing and locking the fastener magazine of FIG. 2 onto the apparatus of FIG. 1, just prior to fixing.
Figure 4:
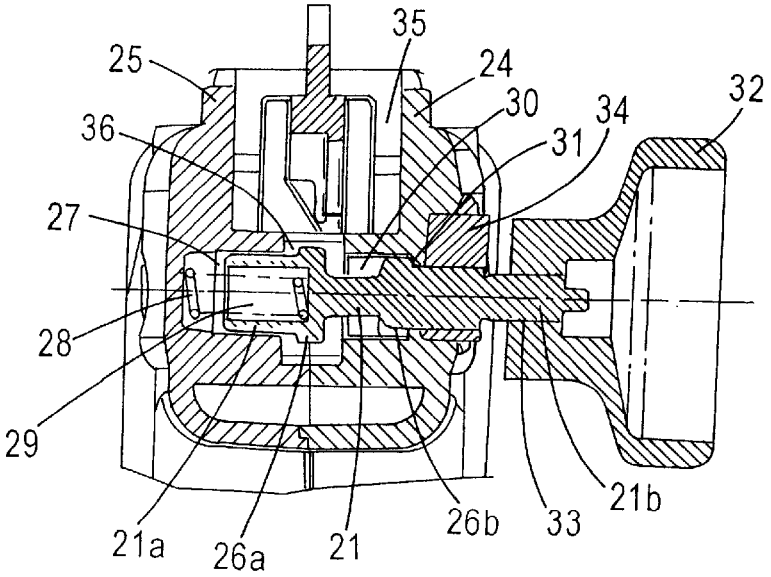
FIG. 4 shows a cross sectional view of the snap fit system of FIG. 3, along the line IV—IV.
Figure 5:
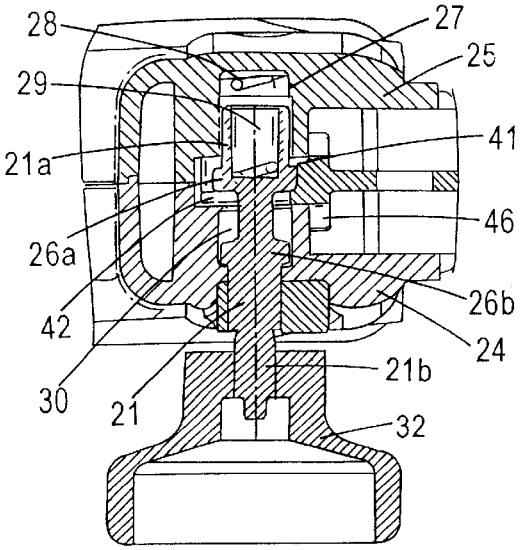
FIG. 5 shows a cross sectional view of the snap fit system of FIG. 3 after fixing and before locking, along the line IV—IV.

In resting position (FIGS. 3 and 4), the shoulder 26*a* is positioned in the receiving space 36, at right angles to the insertion passage 35. The shoulder 26*b* extends to the bottom of its housing 30 and the knob 32, unscrewed, is separated from the stop 34.

The female snap fit part 40 has a cut-out 41 to receive the shoulder 26*a*, extending in the plane P', continued upwards by two symmetrical fingers, rear 42 and front 43, to push and lock the shoulder 26*a*, as will be explained later. The front finger 43 is adjacent to the surface 17 and the rear finger 42 is separate from it, towards the rear.

Fingers 42 and 43 draw in towards each other from their respective ends which connect with the cut-out 41, towards their free ends, separated from each other by a distance slightly greater than the diameter of the spindle 21 The cut-out 41 has an inner wall to receive the shoulder 26*a*, of semicircular shape in longitudinal section in the plane P', oriented towards the upper part of the magazine 2. The inner walls of the fingers 42, 43 extend the inner wall of the cut-out 41, the overall inner wall being circular in shape in longitudinal section (parallel to the plane P'), of diameter substantially greater than that of the shoulder 26*a*, with an opening for the passage of the spindle 21. The fingers 42, 43 are thus intended to lock the shoulder 26*a* into its receiving cut-out 41.

Each finger 42 (43) has a straight external lateral face 44*a*, parallel to the plane P', and another external lateral face 44*b* inclined in relation to the plane P', the width of the finger 42 (43) narrowing from the end connecting with the cut-out 41 towards its free end. The inclined faces 44*b*, thus modelled as wedges, function as pressure surfaces intended to repel the shoulder 26*a* laterally when the male snap fit part 20 is inserted into the female snap fit part 40, as will be explained later.

The section of the lateral opening 47 of the female snap fit part 40 in the plane of the straight lateral face 44*a* is narrowed, smaller than the cross section of the shoulder 26*a* but slightly larger than the cross section of the spindle 21.

The rear finger 42 supports the positioning plate 46 extending at right angles to the plane P' and parallel to the longitudinal axis 19.

A fixing arm is integral with the female snap fit part 40, and extends downwards in the longitudinal plane P', opposite the fingers 42, 43. The fixing arm 45 is received into a slot formed in a projection 48 integral with the lower end part of the surface 17 and screwed to this projection 48.

The width of the cut-out 41, at right angles to the longitudinal plane P', is perceptibly less than the distance separating the two housings 27 and 30, in other words than the width of the space 36, and slightly greater than the width of the shoulder 26*a*.

The operation of mounting the fastener magazine 2 onto the fixing apparatus will now be described.

Firstly an operator indexes the fastener magazine 2 in relation to the fixing apparatus by positioning the skirt 11 in front of its reception compartment 16 and the female snap fit part 40 in the lower insertion passage 35 of the male snap fit part 20.

The operator then pushes the magazine 2 upwards (that is, towards the axis 7). The skirt 11 then fits into its reception compartment 16 and the female snap fit part 40 penetrates into the male snap fit part 20.

When the female snap fit part 40 is introduced into the male snap fit part 20, the positioning plate 46 is accepted and locked into its reception space 32[sic]. In addition, the thrust surfaces 44*b* of the thrust fingers 42, 43 laterally repel the shoulder 26*a*, against the return action of the spring 28, until the reception cut-out 41 is virtually in line with the shoulder 26*a*. The latter then penetrates the reception cut-out 21[sic] under the pressure action of the spring 28, and is stopped against the inner edge of the narrowed lateral opening 47. In this position, the fingers 42, 43 lock and retain the shoulder 26*a* in the reception cut-out 41.

The operator then screws the knob 32 to move it along the spindle 21 until it presses against the stop 34. The knob 32 is thus blocked from axial translatory motion, which prevents the operator from moving the spindle 21. The shoulder 26*a* is thus locked into the reception cut-out 41, which ensures that the fastener magazine 2 is locked in a functioning position onto the fixing apparatus.

Once the fastener magazine 2 has been fixed, the fastener at the head of the strip is inserted into the fastener reception passage of the shearing unit 4, via the input passage 12, through the thrust action of the thrust system of the magazine 2. In order to fix a fastener into a support, the operator presses the apparatus against that support. When pressing the apparatus against the support, the operator advances the casing 1, integral with the shearing unit 4 and with the fastener-guide carrier 13, in relation to the fastener-guide 3, the free end of which is pressed against the support. Pressing against the support causes the closure of the combustion chamber, into which compressed gas is injected, and causes the anti-firing safety system to be unlocked. Then the operator triggers the firing in order to make the compressed gas contained in the combustion chamber explode. The piston is then propelled forwards and strikes the fastener taken into the reception passage of the shearing unit 4. The striking action causes the shearing of the ring strip and the fastener, now detached, is projected forwards and guided by the guide passage of the fastener-guide until it penetrates the support.

Figure 8:
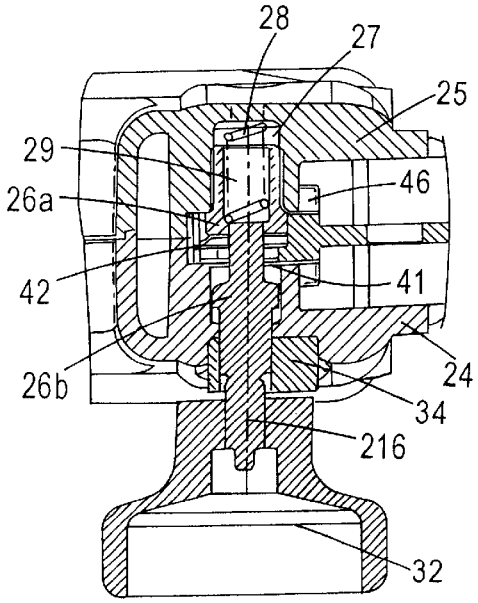
FIG. 8 shows a cross sectional view of the snap fit system of FIG. 3 after unlocking, along the line IV—IV.

To remove the fastener magazine 2, the operator separates the knob 32 from the stop 34 by unscrewing, then pushes it towards the stop 34 against the return action of the spring 38 moving the spindle 21 axially until the shoulder 26*a* is stopped against the edge of the housing 27. In this position (FIG. 8), the shoulder 26*a* is no longer held in the reception cut-out 21[sic] by the fingers 42, 43, and the operator separates the male 20 and female 40 snap fit parts by pulling the fastener magazine 2 downwards.

When the magazine has been removed, the fixing apparatus can be used to fix a fastener pre-mounted onto a part to be fixed, or to fix a fastener into a deep section.

For safety purposes, a shutter may be provided to close up the fastener input passage of the skirt of the shearing unit after removal of the fastener magazine.

What is claimed is:

1. A fastener driving apparatus, comprising:

a gun, comprising an intermediate chamber for temporarily storing a fastener to be fired out of said apparatus in a firing direction; and a strike assembly and a fastener guide arranged on opposite sides of said intermediate chamber for respectively driving and guiding the fastener out of said apparatus in said firing direction; and a replaceable fastener magazine for supplying the fastener to said intermediate chamber of said gun;

wherein said fastener magazine is attached to said gun at least two distinct locations;

said fastener magazine is attached to said intermediate chamber at one of said two distinct locations;

said fastener magazine is attached to said gun at the other of said at least two distinct locations by snap fit; and said snap fit is achieved by first and second members formed in said gun and said fastener magazine, respectively, the first member comprises a spindle provided with a shoulder, the second member comprises a cut-out adapted to receive and lock the shoulder therein.

2. The apparatus of claim 1, wherein the spindle is mounted in said gun to be movable in first and second opposite directions.

3. The apparatus of claim 2, wherein the spindle is movable only within predetermined limits defined by stops spaced along said first or second directions.

4. The apparatus of claim 2, wherein the first member further comprises a biasing element for biasing the spindle in said first direction.

5. The apparatus of claim 2, wherein the first member further comprises a locking mechanism for locking the spindle against a movement thereof in said second direction.

6. The apparatus of claim 5, wherein the locking mechanism includes a knob fastened to an end of the spindle by thread.

7. The apparatus of claim 1, wherein the second members further comprises two fingers defining the cut-out therebetween, each finger has a spindle receiving section and a wedge section, a distance between the fingers in a region of the wedge section is larger than a diameter of the spindle but smaller than a diameter of the shoulder, the distance between the fingers in a region of the spindle receiving section is larger than the diameter of the shoulder.

8. The apparatus of claim 7, wherein the spindle is mounted in said gun to be movable in first and second opposite directions, the first member further comprises a biasing element for biasing the spindle in said first direction, and the wedge sections of the fingers are configured to push the spindle in said second direction when the second member approaches to engage with the first member by said snap fit.

9. The apparatus of claim 8, wherein the spindle is movable only within predetermined limits defined by stops spaced along said first or second directions, and each finger has a thickness smaller than a spacing between said stops.

10. The apparatus of claim 1, wherein the first member further comprises a passage for allowing the second member to approach to the shoulder, the passage extends substantially perpendicular to the spindle, the first member further comprises a biasing element for biasing the spindle, in a rest state when the first and second members have not been engaged, in alignment with the passage.

* * * * *